United States Patent [19]

Murray

[11] Patent Number: 4,521,984

[45] Date of Patent: Jun. 11, 1985

[54] MENU BOARD FRAME AND INSERT

[75] Inventor: Ledell L. Murray, Noblesville, Ind.

[73] Assignee: General Indicator Corporation, Pardeeville, Wis.

[21] Appl. No.: 553,142

[22] Filed: Nov. 17, 1983

Related U.S. Application Data

[63] Continuation of Ser. No. 433,836, Oct. 12, 1982, abandoned.

[51] Int. Cl.[3] ..... G09F 13/04

[52] U.S. Cl. ..... 40/576; 40/490; 40/491; 40/611

[58] Field of Search ..... 40/576, 575, 611, 489, 40/490, 491, 486, 488, 618, 564, 572, 5

[56] References Cited

U.S. PATENT DOCUMENTS

| | | | |
|---|---|---|---|
| 1,414,536 | 5/1922 | Webster et al. | 40/576 |
| 2,319,910 | 5/1943 | Adler | 40/576 |
| 3,685,186 | 8/1972 | Goodman | 40/576 |
| 3,939,584 | 2/1976 | Trame | 40/576 |

FOREIGN PATENT DOCUMENTS

| | | | |
|---|---|---|---|
| 681176 | 7/1929 | France | 40/576 |

*Primary Examiner*—Gene Mancene
*Assistant Examiner*—James R. Hakomaki
*Attorney, Agent, or Firm*—Bayard H. Michael

[57] ABSTRACT

The parallel rails have a double tee cross section and the leg of the rear T fits into slots in the sides of the frame. When the frame is welded, the rails are captured with the front slots ahead of the frame so menu strips and price modules can be mounted from either end and will mesh with each other or lie over the frame to prevent light leaks.

4 Claims, 7 Drawing Figures

MENU BOARD FRAME AND INSERT

This application is a continuation of Ser. No. 433,836 filed Oct. 12, 1982 now abandoned.

BACKGROUND OF THE INVENTION

This invention relates to menu boards of the type used in fast food restaurants to display the names and prices of the items offered. Menu boards (signs) are made of various materials. They have generally been customized in design and frequently the design has limited the utility of the board in that name or price were difficult to change. Any changes in the dimensions of the board required extensive and costly adaptation of the design. The usual price module is fixed in place at the end of the line—it cannot be readily adjusted to another place on the line.

SUMMARY OF THE INVENTION

The object of this invention is to provide a relatively low-cost menu board having superior construction features which permit a ready change of the inserts and also permit ready change of the dimensions of the board.

The frame for the display board is fabricated from the stamped parts which have good rigidity. The length of these parts can be very readily adjusted to meet the dimensional requirements of the job at hand. The actual support structure comprises parallel rails having a T-shaped configuration at the front and rear. The rear T-shaped configuration results in a web (leg of the T) connecting the back of the rail to the main part of the rail with opposed slots on each side of the web. This allows each end of the rail to be mounted in a slot in the vertical frame member which support the rail at each end without any welding or the like. All that is necessary is that the rails be mounted in place before the frame members are welded. This then captures all the parallel rails, but gives them a little freedom of movement to adjust for manufacturing errors, expansion and contraction. Each rail has slots just behind the front surface of the rail and these cooperate with adjacent slots to support the name or price insert strip in front of the frame so the inserts can be added or removed at either end.

The length of the top and bottom frame members and the length of the extruded rails can be readily adjusted to accommodate changes in the horizontal dimension of the assembly. The vertical dimension is simply adjusted by changing the length of the vertical members. The spacing of the rails to accommodate different size inserts is very simply adjusted by simply changing the spacing of the slots which receive the ends of the rails. The rear upper slot in the upper rails receives the adjacent edge of the horizontal frame member throughout the length of the rail and similarly the bottom rear slot in the bottom rail receives the edge of the bottom frame member throughout its length. This prevents any light leakage at that point. The price module bezel can be placed anywhere along the rails and has a face which is flush with the front of the rails and extends beyond the parts engaged in the rails to permit a display strip to project behind the face to prevent unsightly light leaks.

The rails are tapered towards the rear of the rail to guard against casting shadows on the display strip.

DETAILED DESCRIPTION OF THE DRAWINGS

Figure 1:
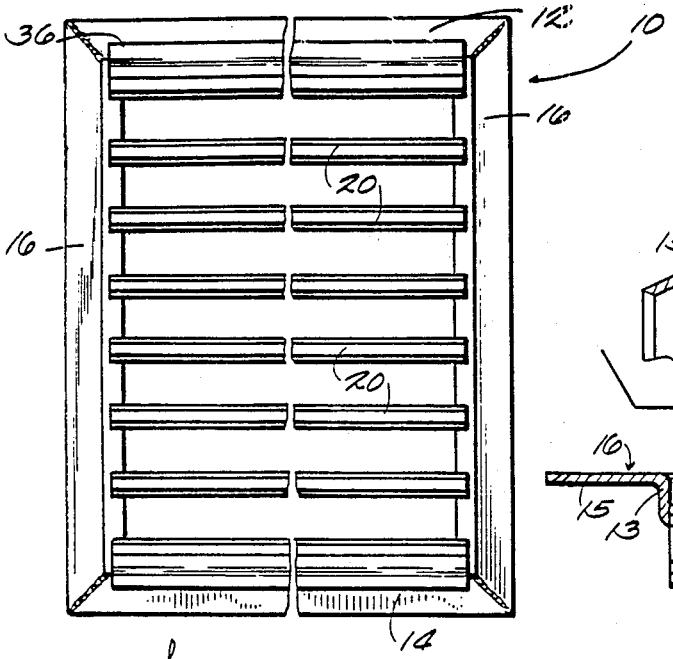
FIG. 1 is an elevation of the frame assembly.
Figure 3:
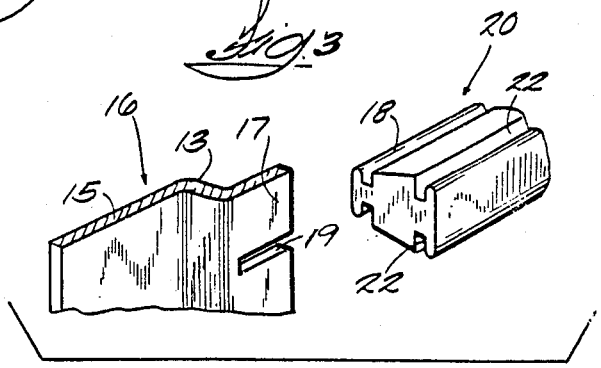
FIG. 3 is an enlarged detail view in perspective showing how the rails fit into the end members of the frame.
Figure 4:
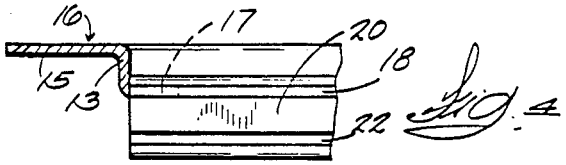
FIG. 4 is a fragmentary section taken on line 4—4 in FIG. 2 showing the end of a rail engaged in the frame end member.
Figure 5:
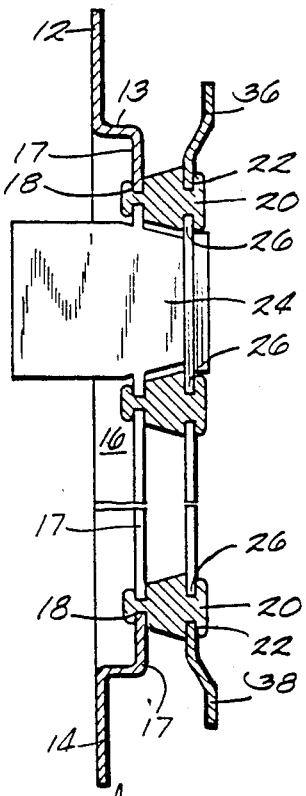
FIG. 5 is a section on line 5—5 in FIG. 2.

The frame 10 has a top 12 and bottom 14 and sides 16 each of which has a "Z" cross section (front 17 and back 15 are parallel and interconnected by a leg 13 normal to each) to resist bending. The fronts 17 of sides 16 having slots or notches 19 receiving the back web or leg 18 of the back Tee of the spaced parallel rails 20. After all the rails are positioned, the mitered corners of the frame are welded to finish the assembly and retain the rails without need for welding each rail in place. As a matter of fact, there is advantage in the slightly loose fit of the rails in the sides . . . it allows for manufacturing tolerance and dimensional changes. The length of the sides, rails, etc. can readily be changed to change the size of the finished menu board. The frame is made of formed metal and the rails are extruded so the length of the parts is easily changed.

Figure 2:
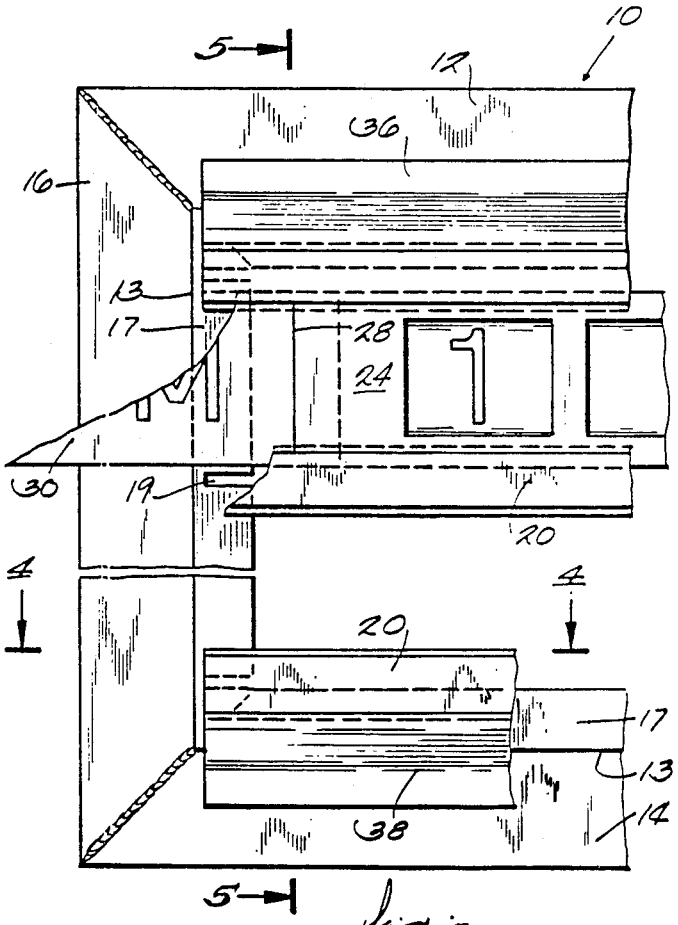
FIG. 2 is an enlarged detail of FIG. 1 with parts broken away and a menu strip in process of mounting.
Figure 6:
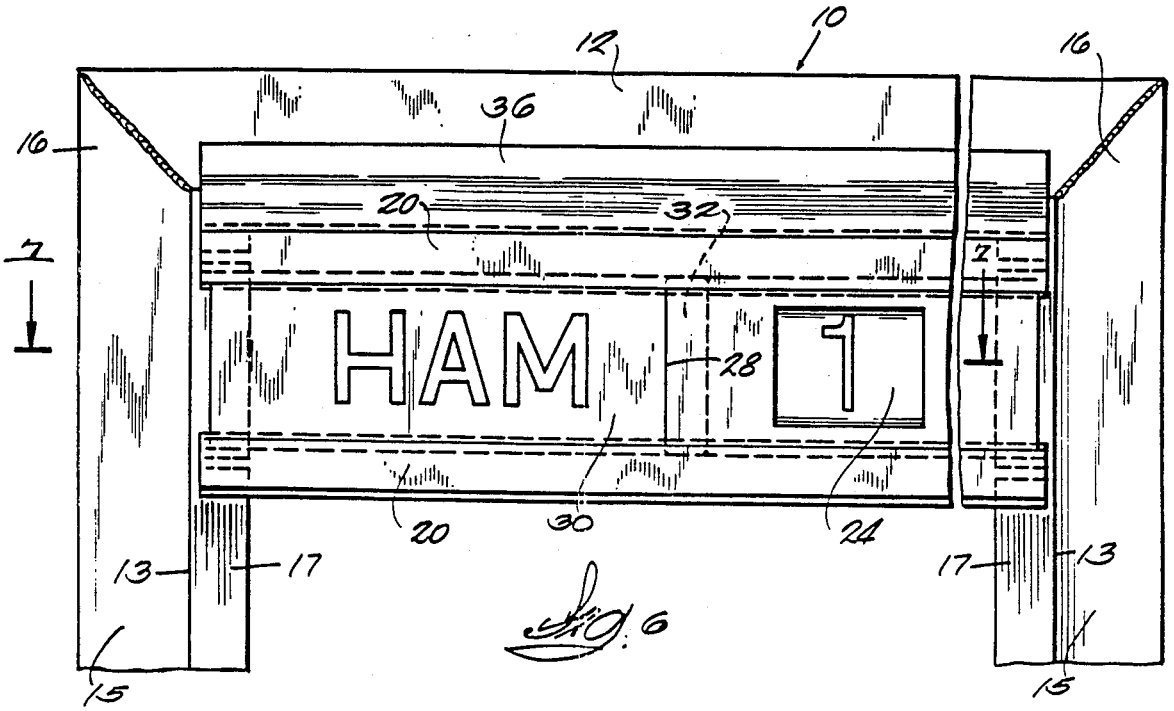
FIG. 6 is an enlarged detail showing how the strip and price module are related to each other when mounted.
Figure 7:
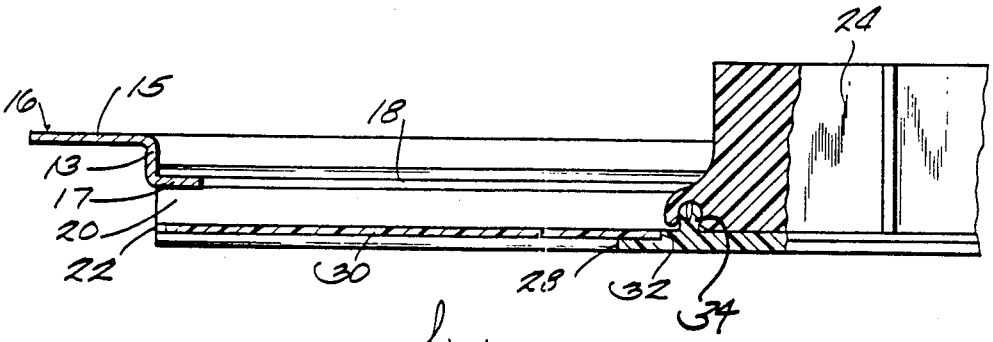
FIG. 7 is a section on line 7—7 of FIG. 6.

It will be noted each rail has what I call a double Tee cross section. The back tee fits into the frame sides and the front tee is, therefore, positioned ahead of the frame sides. This means the mounting grooves 22 are in front of the frame and are accessible from either end (which is not true in the prior art). Therefore, the price module bezel and menu strip can be slipped in either end as shown in FIG. 2. The price display module has a bezel which includes an apertured mask 24 which fits between the front edges of the rails while the mounting edges 26 fit into the grooves 22. The edges 26 do not extend to the end of the mask but, to the contrary, terminate short of the ends 28 of the mask. This permits one end of the mask to extend past the inner edge of the frame side 16 to prevent a light leak at that point. Menu strips 30 bearing names of menu items are mounted in and are coplanar with grooves 22 so the end 32 of a menu strip can extend behind the end 28 of the price module mask to prevent a light leak.

The module mask includes mounting tabs 34 to which the price coil support structure is mounted after the mask is mounted in the rails. Details of the support structure are shown and claimed in my copending application Ser. No. 423,692. Obviously, the mounting tabs cannot extend back of the mask more than the clearance to the side of the frame.

It will be noted the rail surfaces converge towards the rear of the rail. This minimizes the chance for the lights behind the panel casting shadows on the price strips 30 and also cooperates with the price modules in improving friction on the coiled price strips as set out in detail in said application.

It will be noted the top rail has an additional structural member 36 mounted in the upper slot 22. This permits the frame to be easily mounted in still another frame or light box. The bottom rail has a similar member 38 welded into the slot.

I claim:

1. A sign assembly comprising, a frame having horizontal and vertical members, each member having a "Z-shaped" cross section with parallel front and back portions interconnected by a leg normal to each portion, the back portion extending from the leg towards the outside of the frame and the front portion extending from the leg towards the inside of the frame, a plurality of parallel, spaced apart extruded rails extending between the vertical frame members, each rail having front, rear, top and bottom surfaces of equal length, opposed slots in the top and bottom surfaces adjacent the front surface and the rear surface of the rail so the front and rear of the rail are connected to the main body of the rail by front and rear webs respectively, each end of the rear web of each rail being received and retained in a slot in the inner edge of the front portion of the vertical frame members, the vertical frame members being dimensioned so the slots adjacent the front of the rails are positioned in front of the frame members to allow items to be received in the ends of the slots.

2. An apertured bezel mounted in the assembly of claim 1, said bezel having spaced parallel edges received in opposed front slots of a pair of rails, a mask in front of the edges of the bezel and fitting between the rails generally flush with the fronts of the rails, said mask extending beyond the end of the bezel.

3. A sign assembly according to claim 1 in which the top and bottom surfaces of the rails converge towards the rear.

4. A sign assembly comprising, a frame having a top, bottom and sides each of which has a "Z-shaped" cross section having a front and back interconnected by a leg normal to each, spaced parallel horizontal extruded rails between the sides of the frame, the ends of each rail being received in a slot in each side of the frame whereby the rails are captured between the sides, the front of each rail lying in front of the foremost plane of the frame, a slot in the top and bottom of each rail adjacent the front of the rail to be accessible from either end of the slot to receive and support an edge of a display device mounted between the rails.

* * * * *